US010858150B2

(12) United States Patent
Goda

(10) Patent No.: US 10,858,150 B2
(45) Date of Patent: Dec. 8, 2020

(54) SECURING DEVICE

(71) Applicant: Hideyuki Goda, Tokyo (JP)

(72) Inventor: Hideyuki Goda, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 133 days.

(21) Appl. No.: 16/261,845

(22) Filed: Jan. 30, 2019

(65) Prior Publication Data

US 2019/0248542 A1 Aug. 15, 2019

(30) Foreign Application Priority Data

Feb. 14, 2018 (JP) ..... 2018-023909

(51) Int. Cl.

| | |
|---|---|
| ***B65D 19/20*** | (2006.01) |
| ***B65D 85/68*** | (2006.01) |
| ***B65D 81/05*** | (2006.01) |
| ***B65D 19/44*** | (2006.01) |
| ***B65D 19/06*** | (2006.01) |

(52) U.S. Cl.

CPC ..... *B65D 19/20* (2013.01); *B65D 19/06* (2013.01); *B65D 19/44* (2013.01); *B65D 81/056* (2013.01); *B65D 85/68* (2013.01); *B65D 2519/00019* (2013.01); *B65D 2519/00029* (2013.01); *B65D 2519/00044* (2013.01); *B65D 2519/00064* (2013.01); *B65D 2519/0081* (2013.01); *B65D 2519/00099* (2013.01); *B65D 2519/00159* (2013.01); *B65D 2519/00194* (2013.01); *B65D 2519/00273* (2013.01); *B65D 2519/00293* (2013.01); *B65D 2519/00323* (2013.01); *B65D 2519/00333* (2013.01); *B65D 2519/00497* (2013.01); *B65D 2519/00567* (2013.01); *B65D 2519/00572* (2013.01); *B65D 2519/00621* (2013.01); *B65D 2519/00661* (2013.01); *B65D 2519/00716* (2013.01); *B65D 2519/00815* (2013.01); *B65D 2585/689* (2013.01); *B65D 2585/6892* (2013.01)

(58) Field of Classification Search

USPC ..... 206/598, 600; 108/56.1, 56.3, 55.1
See application file for complete search history.

(56) References Cited

U.S. PATENT DOCUMENTS 3,685,463 A * 8/1972 Francis ..... B65D 19/0028 108/56.3
4,079,907 A * 3/1978 Mykleby ..... B60P 7/00 108/55.1

(Continued)

FOREIGN PATENT DOCUMENTS

JP 5-193644 8/1993
JP 2009-143586 7/2009

(Continued)

*Primary Examiner* — Jacob K Ackun
(74) *Attorney, Agent, or Firm* — Harness, Dickey & Pierce, P.L.C.

(57) ABSTRACT

A securing device includes a base and a sheet placed on the base. The sheet includes a hole. A securing support is disposed opposite the hole of the sheet. A coupler secures the sheet to the base through the securing support. The securing support includes a contact face that contacts the coupler. The contact face includes a notch through which the securing support is removed from the coupler to separate the base from the sheet without removing the coupler.

10 Claims, 8 Drawing Sheets

(56) References Cited

U.S. PATENT DOCUMENTS

| | | | | | |
|---|---|---|---|---|---|
| RE35,870 | E * | 8/1998 | Durand | B65D 19/0026 | 108/56.3 |
| 5,899,337 | A * | 5/1999 | Thebeault | B65D 19/0097 | 206/600 |
| 6,126,002 | A * | 10/2000 | Brown | B65D 19/14 | 206/320 |
| 6,216,899 | B1 * | 4/2001 | Vicari | B65D 19/16 | 206/600 |
| 7,578,244 | B2 * | 8/2009 | Williams, Jr. | B65D 19/0095 | 108/56.3 |
| 8,322,664 | B2 * | 12/2012 | Booth | B65D 19/20 | 248/152 |
| 2005/0196080 | A1 * | 9/2005 | Stone | B65D 88/1631 | 383/119 |
| 2008/0066657 | A1 * | 3/2008 | Kuo | B65D 19/18 | 108/57.19 |
| 2009/0025342 | A1 | 1/2009 | Ishikawa et al. | | |
| 2009/0242456 | A1 | 10/2009 | Goda | | |
| 2010/0213088 | A1 | 8/2010 | Goda | | |
| 2011/0048990 | A1 | 3/2011 | Goda | | |

FOREIGN PATENT DOCUMENTS

| | | |
|---|---|---|
| JP | 2010-195411 | 9/2010 |
| JP | 2012-109473 | 6/2012 |

* cited by examiner

SECURING DEVICE

CROSS-REFERENCE TO RELATED APPLICATION

This patent application is based on and claims priority pursuant to 35 U.S.C. § 119(a) to Japanese Patent Application No. 2018-023909, filed on Feb. 14, 2018, in the Japan Patent Office, the entire disclosure of which is hereby incorporated by reference herein.

BACKGROUND

Technical Field

Exemplary aspects of the present disclosure relate to a securing device, and more particularly, to a securing device used for a packing apparatus.

Discussion of the Background Art Related-art packing apparatuses for packing a large product such as a copier and a printer are conveyed by a forklift Such packing apparatuses include a pallet including a fork insertion opening. The product is placed on the pallet. A box for packaging the product is placed above the product. The box packaging the product is secured onto and combined with the pallet. The pallet and the box that are combined are stored and transported.

The box used in the packing apparatus is generally made of corrugated cardboard. The pallet is also made of corrugated cardboard. However, the pallet is often made of plywood or wood in view of strength and durability.

Various technologies are proposed for the packing apparatus to secure the box storing an article such as the product to the pallet.

SUMMARY

This specification describes below an improved securing device. In one embodiment, the securing device includes a base and a sheet placed on the base. The sheet includes a hole. A securing support is disposed opposite the hole of the sheet. A coupler secures the sheet to the base through the securing support. The securing support includes a contact face that contacts the coupler. The contact face includes a notch through which the securing support is removed from the coupler to separate the base from the sheet without removing the coupler.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
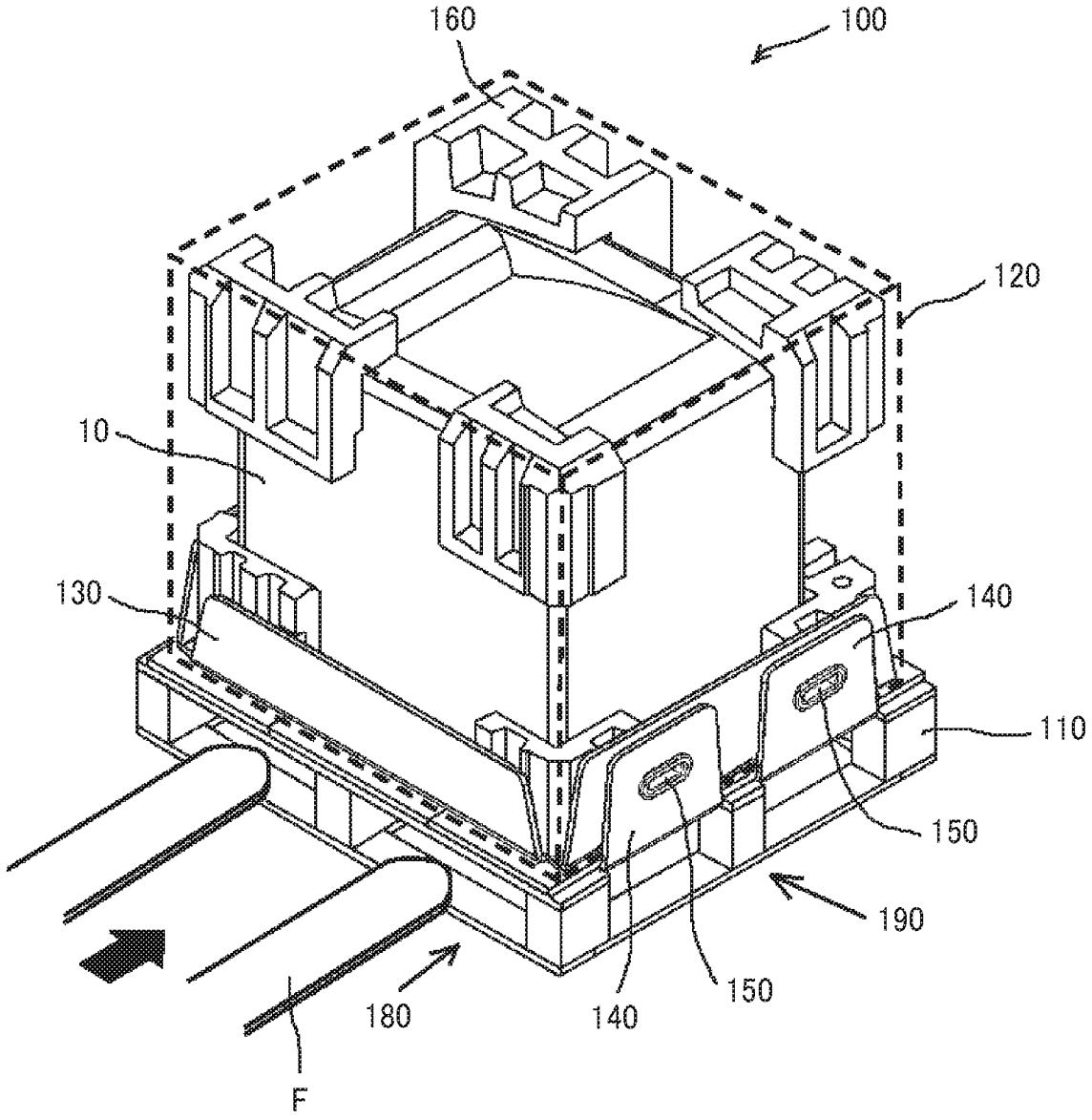
FIG. 1 is a perspective view of a packing apparatus as a comparative example.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring now to the drawings, wherein like reference numerals designate identical or corresponding parts throughout the several views, particularly to FIG. 1, a packing apparatus 100 as a first comparative example is explained.

Figure 2:
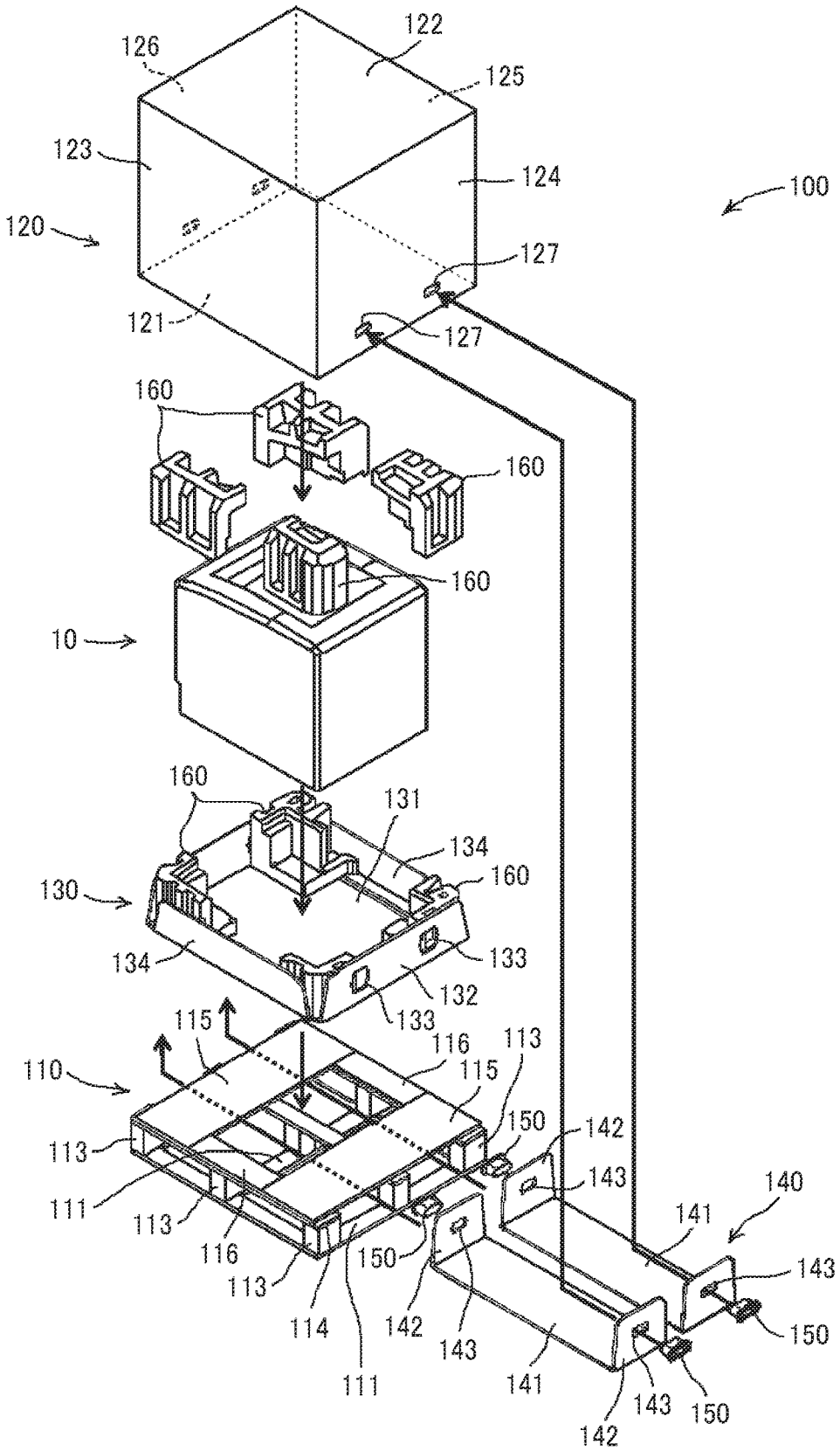
FIG. 2 is an exploded perspective view of the packing apparatus depicted in FIG. 1.

FIG. 1 is a perspective view of the packing apparatus TOO. FIG. 2 is an exploded perspective view of the packing apparatus 100 depicted in FIG. 1.

As illustrated in FIG. 1, the packing apparatus 100 packs goods, for example, a product 10 such as a printer. The packing apparatus 100 includes a pallet 110, a box 120, an underlay 130, two sheets 140, joints 150, and eight cushioning materials 160. The product 10 is placed on the pallet 110. The box 120 covers sides and a top of the product 10. The underlay 130 is disposed between the pallet 110 and the product 10. The two sheets 140 are hooked round the pallet 110 and coupled with the box 120. The joints 150 are fastened to couple the box 120 to the sheets 140. The cushioning materials 160 are disposed between the product 10 and the pallet 110 and between the product 10 and the box 120.

A description is provided of a construction of the pallet 110.

The pallet 110 is made of plywood or wood and has a substantially rectangular contour when projected on a plane. Alternatively, the pallet 110 may be made of materials other than wood.

As illustrated in FIG. 2, the pallet 110 includes bottom boards 111, nine blocks 113, top boards 114, deck boards 115, and spacers 116. The blocks 113, serving as a support, are disposed on the bottom boards 111. The top boards 114 are disposed on the blocks 113. The deck boards 115 are disposed on the top boards 114. Each of the spacers 116 is disposed at a gap between the deck boards 115. The spacer 116 eliminates a step between the spacer 116 and the deck board 115 and prevents dust and the like from entering an inside of the box 120 through the gap. Details of the construction of the pallet 110 are omitted.

With the construction described above, the pallet 110 has a substantially square contour defined by four sides. Two opposing sides of the four sides define fork insertion sides 180 depicted in FIG. 1 between the bottom boards 111 and the top boards 114. A fork F of a cargo handling device is inserted through the fork insertion sides 180 as illustrated in FIG. 1. Other two opposing sides of the four sides define fork non-insertion sides 190 through which the fork F is not inserted.

As the fork F is inserted through one of the fork insertion sides 180, a lower face of the top board 114 contacts an upper face of the fork F, thus serving as a fork contact portion.

A description is provided of a construction of the box 120.

The box 120 is made of corrugated cardboard. The box 120 is produced such that the box 120 is accommodated within a planar contour of the pallet 110 by considering the height of the product 10 also. As illustrated in FIG. 2, the box 120 includes an opening 121, a lid 122, and four vertical walls 123, 124, 125, and 126. The product 10 placed on the pallet 110 is inserted into the box 120 through the opening 121 disposed at a bottom of the box 120. The lid 122 disposed at a top of the box 120 covers the top of the product 10. The four vertical walls 123, 124, 125, and 126 surround a periphery of the product 10. Bottom edges of the vertical walls 123, 124, 125, and 126 that define a peripheral edge of the opening 121 contact upper faces of the deck boards 115 and the spacers 116 that construct the pallet 110.

Each of the two vertical walls 124 and 126 of the four vertical walls 123, 124, 125, and 126, which is disposed on the fork non-insertion side 190, is provided with two through holes 127 at two positions in proximity to the opening 121, respectively.

A description is provided of a construction of the underlay 130.

The underlay 130 is made of corrugated cardboard. The underlay 130 is disposed inside the box 120 and placed on the pallet 110. The product 10 is placed on the underlay 130. As illustrated in FIG. 2, the underlay 130 includes a bottom plate 131, upright pieces 132, and stand pieces 134. The product 10 is placed on the bottom plate 131 that is rectangular. The upright pieces 132 are bent upward from two sides of four sides of the bottom plate 131 as boundaries. The two sides of the bottom plate 131 are at the fork non-insertion sides 190, respectively. The stand pieces 134 are bent upward from other two sides of the four sides of the bottom plate 131 as boundaries. The other two sides of the bottom plate 131 are at the fork insertion sides 180, respectively.

The bottom plate 131 is great enough to load the product 10 and small enough to be accommodated inside the box 120 through the opening 121. The upright piece 132 includes slots 133 that correspond to the through holes 127 when the box 120 is placed on the pallet 110. When the joints 150 couple the box 120 to the sheets 140, the slots 133 prevent the joints 150 from coming into contact with the underlay 130. The slot 133 is greater than the through hole 127 in shape dimension. The upright pieces 132 and the stand pieces 134 that are bent upward abut on the cushioning materials 160 that position the product 10.

The bottom plate 131 of the underlay 130 includes holes that position the cushioning materials 160, respectively. A projection mounted on a back face of each of the cushioning materials 160 engages the hole of the bottom plate 131 to position each other.

A description is provided of a construction of the sheet 140.

The sheet 140 is made of corrugated cardboard. As the sheet 140 is inserted into a gap between the bottom board 111 and the top board 114 from the fork non-insertion side 190 of the pallet 110, the sheet 140 is hooked across the pallet 110 and coupled to the box 120 by the joint 150, thus securing the box 120 to the pallet 110. The sheet 140 includes a plate 141 and arms 142. The plate 141 is substantially rectangular and contacts a lower face of the deck board 115 defining the top board 114 of the pallet 110. The arms 142 are bent upward from two opposing sides of four sides of the plate 141 as boundaries.

Each of the arms 142 is sized to cover the through hole 127 of the box 120 in a state in which the arms 142 are protruded from the pallet 110 and bent upward. Each of the arms 142 includes an insertion slot 143 disposed opposite the through hole 127 in a state in which the arm 142 covers the through hole 127.

A description is provided of a configuration of the joint 150.

The joint 150 is made of synthetic resin. The joint 150 couples and decouples two plates by operation at an outside of the sheet 140 and the box 120 without a tool or the like.

A description is provided of a configuration of the cushioning materials 160.

The cushioning materials 160 are made of resin foam. The four cushioning materials 160 are disposed between a bottom of the product 10 and the underlay 130 and between the top of the product 10 and the box 120, respectively. The cushioning materials 160 are made of resin foam, for example, expanded polystyrene (EPS) and expanded polyethylene (EPE) in accordance with the shape of the product 10. The cushioning materials 160 disposed below the product 10 prevent displacement of the product 10 on the underlay 130. The cushioning materials 160 disposed above the product 10 prevent shaking of the product 10 inside the box 120. For example, a projection is disposed on a lower face of each of the cushioning materials 160 disposed below the product 10. The underlay 130 includes a slot that engages the projection of the cushioning material 160. As the projection engages the slot, the cushioning material 160 is positioned on the underlay 130 precisely.

Referring to FIG. 2, a description is provided of processes for packing the product 10 with the packing apparatus 100 having the construction described above.

The underlay 130 is placed on the pallet 110. The upright pieces 132 and the stand pieces 134 are bent upward from the boundaries, respectively.

The four cushioning materials 160 disposed below the product 10 are disposed on four corners of the underlay 130. As the projection disposed on the lower face of the cushioning material 160 engages the slot of the underlay 130, the cushioning material 160 is positioned on the underlay 130.

The product 10 is placed on the cushioning materials 160. Accordingly, the product 10 is placed on the pallet 110.

The box 120 covers the product 10. The box 120 with the opening 121 facing down moves downward to cover the product 10. The top of the box 120 is openable. The box 120 with the top that is opened covers the product 10. Thereafter, the four cushioning materials 160 are placed on the product 10. Then, the opened top of the box 120 is closed and sealed with tape. In a state in which the box 120 is placed on the pallet 110, the vertical walls 123, 124, 125, and 126 of the box 120 are disposed outside the underlay 130. The bottom edges of the vertical walls 123, 124, 125, and 126 that define the peripheral edge of the opening 121 contact the deck boards 115 and the spacers 116. Since the spacers 116 are disposed between the deck boards 115, the bottom edges of the vertical walls 123, 124, 125, and 126 uniformly contact an upper face of the pallet 110. Accordingly, even if a plurality of packing apparatuses 100 is stacked, load is distributed, preventing breakage of the box 120. Additionally, dust and the like do not enter the box 120.

The two sheets 140 are inserted into the pallet 110 from the fork non-insertion side 190. While the arms 142 of each of the sheet 140 are bent upward at the boundaries, respectively, the plate 141 is brought into contact with the lower face of the deck board 115 and the sheet 140 is hooked across the pallet 110. The insertion slots 143 disposed in the arms 142 are aligned with the through holes 127 disposed in the vertical walls 124 and 126 of the box 120, respectively. The joints 150 inserted in the insertion slots 143 are inserted into the through holes 127, respectively, and operated to couple the sheet 140 to the box 120.

Accordingly, while the product 10 is placed on the pallet 110, the box 120 is secured to the pallet 110. Although the product 10 is not secured to the pallet 110 and the box 120 directly, since the product 10 is secured to the underlay 130 and the box 120 through the cushioning materials 160, the product 10 is placed on the pallet 110 stably.

As the fork F depicted in FIG. 1 of the cargo handling device is inserted from the fork insertion side 180 of the pallet 110, the product 10 packed by the packing apparatus 100 is ready for cargo handling.

However, since the sheets 140 are configured to be coupled to the box 120 through the pallet 110, the two sheets 140 are provided separately from the underlay 130, increasing wastes and manufacturing costs. Additionally, during unpacking, after the joints 150 are removed, the sheets 140 are drawn out from the pallet 110, increasing the number of work processes.

Figure 3B:
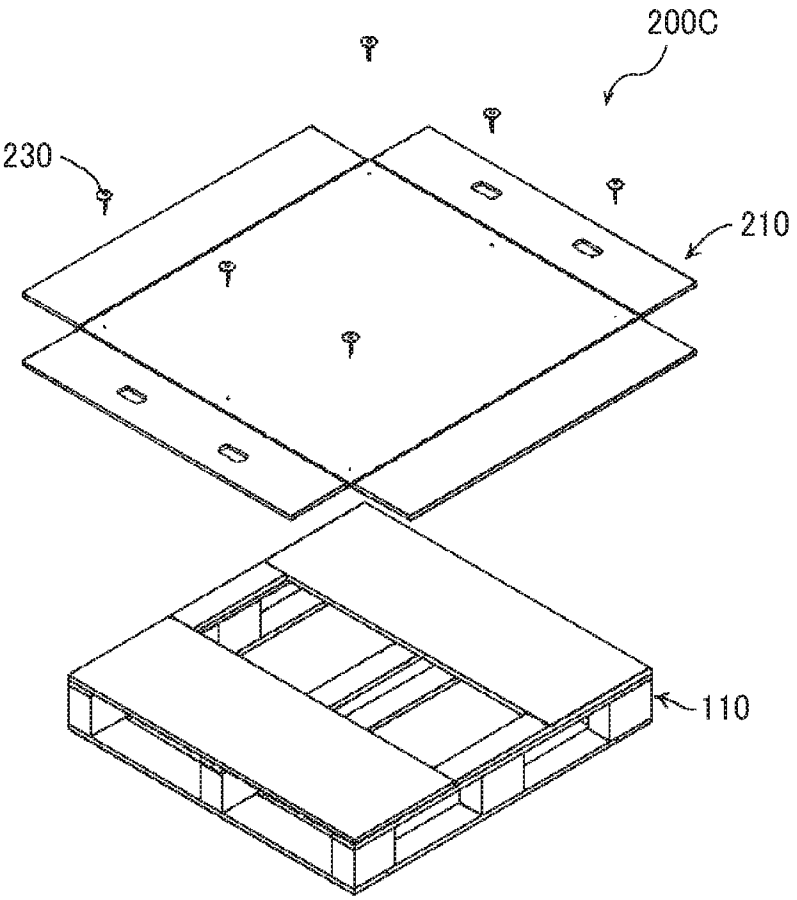
FIG. 3B is an exploded perspective view of the securing device depicted in FIG. 3A.
Figure 3A:
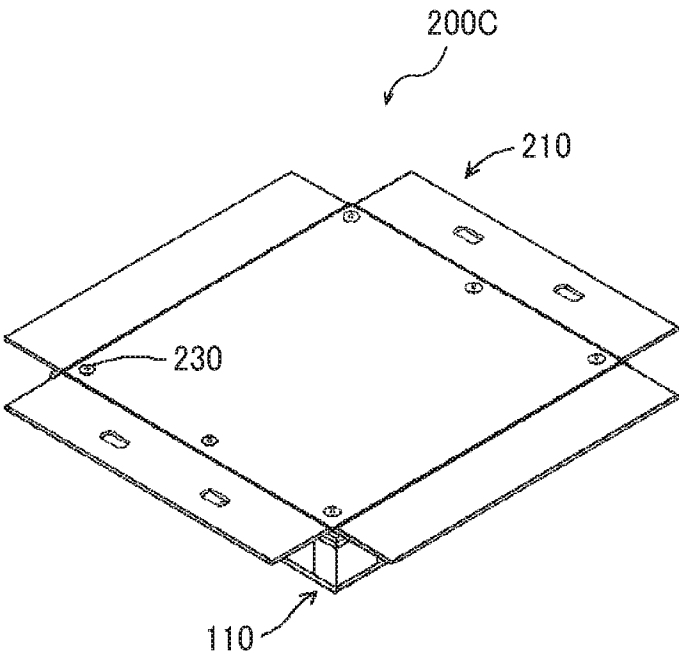
FIG. 3A is a perspective view of a securing device as a comparative example.

FIG. 3A is a perspective view of a securing device 200C, as a second comparative example, that does not include the sheets 140 depicted in FIGS. 1 and 2. FIG. 3B is an exploded perspective view of the securing device 200C. As illustrated in FIGS. 3A and 3B, couplers 230 secure a sheet 210 made of corrugated cardboard onto the pallet 110. The coupler 230 includes a metal screw and a washer. However, in order to separate the sheet 210 from the pallet 110 for disposing, an operator is requested to remove the couplers 230 entirely, increasing the number of work processes.

Alternatively, a joint may penetrate through a through hole of a pallet and a through hole of a sheet to couple the sheet to the pallet. However, when the operator operates a cargo handling device, the cargo handling device may contact the joint, resulting in breakage. Additionally, the through hole is produced in the pallet before use, increasing manufacturing costs.

A description is provided of a construction of a securing device 200 according to embodiments of the present disclosure.

Figure 4B:
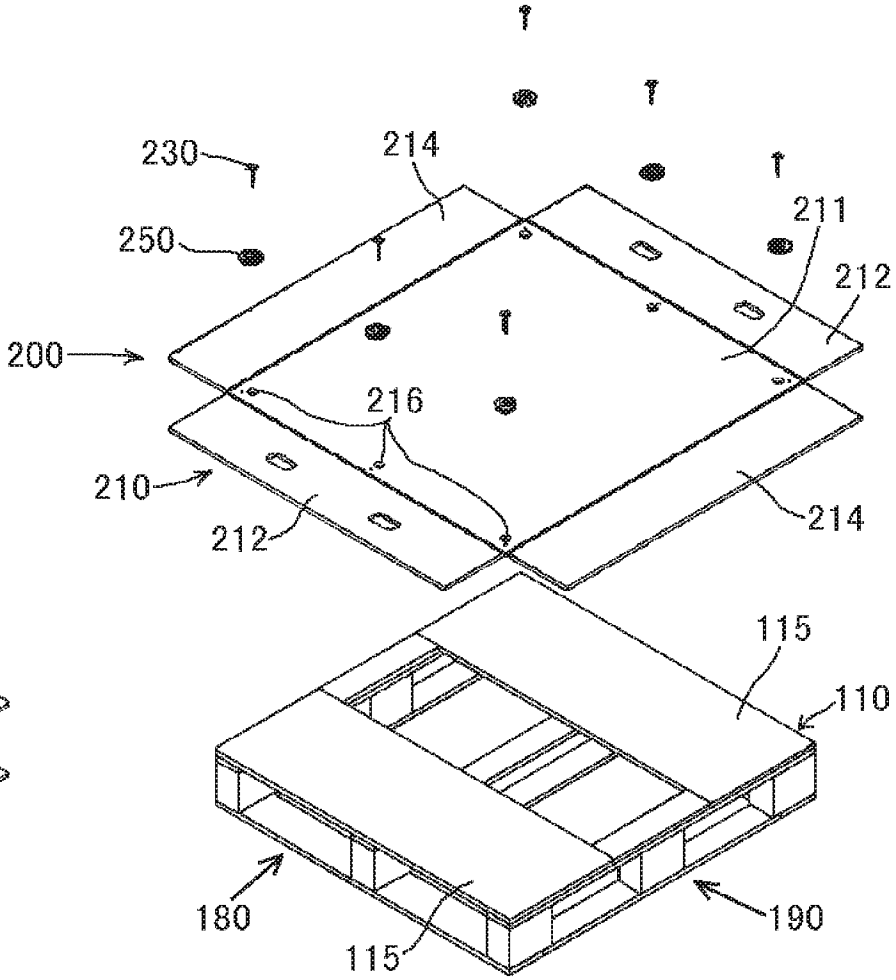
FIG. 4B is an exploded perspective view of the securing device depicted in FIG. 4A.
Figure 4A:
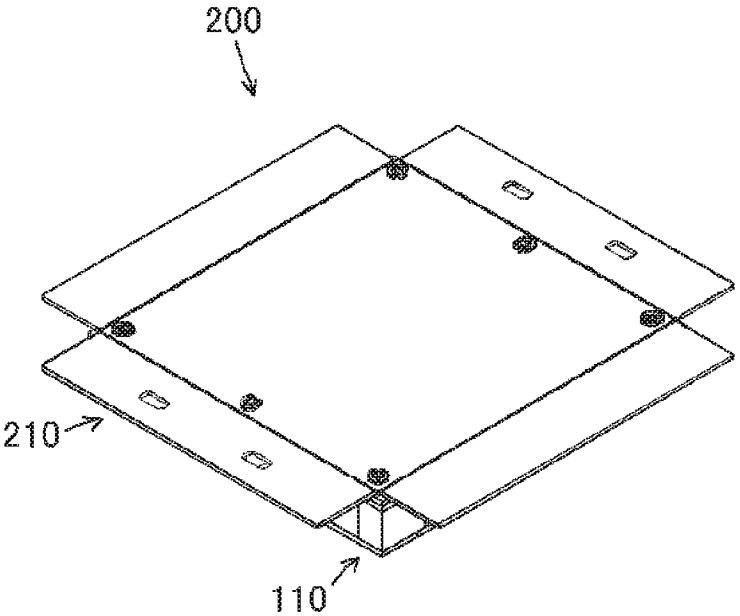
FIG. 4A is a perspective view of a securing device according to an embodiment of the present disclosure.

FIGS. 4A and 4B are schematic views of the securing device 200, respectively. FIG. 4A is a perspective view of the securing device 200. FIG. 4B is an exploded perspective view of the securing device 200.

As illustrated in FIG. 4B, the securing device 200 includes the pallet 110, a sheet 210, spacers 250, and couplers 230. The pallet 110 serves as a base. The sheet 210 includes through holes 216 and is placed on the pallet 110. The spacers 250 serve as securing supports that are disposed opposite the through holes 216 of the sheet 210, respectively. The couplers 230 secure the sheet 210 to the pallet 110 through the spacers 250, respectively.

Figure 5:
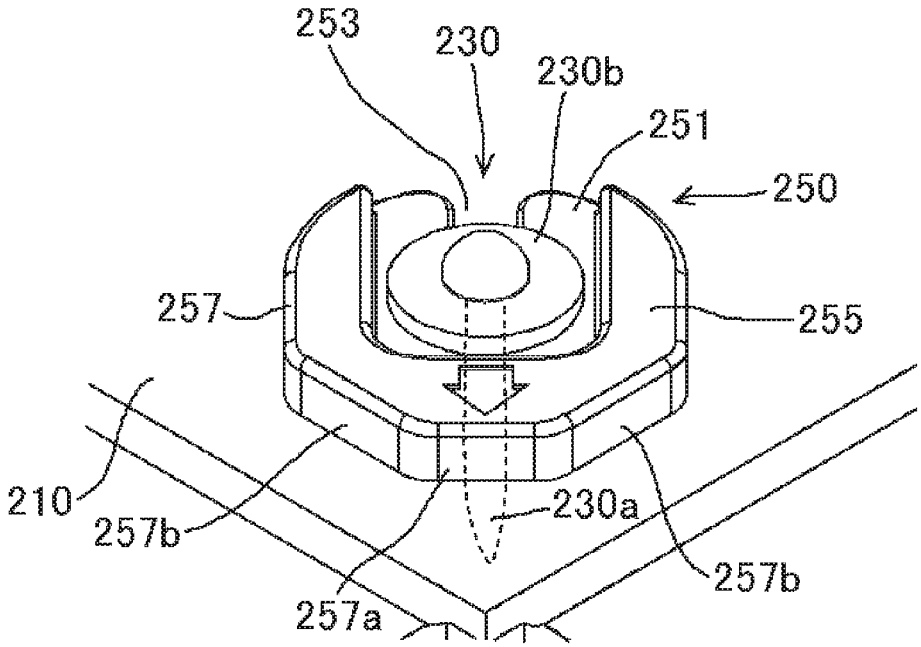
FIG. 5 is a schematic perspective view of a spacer and a coupler incorporated in the securing device depicted in FIG. 4B.

FIG. 5 is a schematic perspective view of the spacer 250 and the coupler 230. As illustrated in FIG. 5, the spacer 250 includes a contact face 251 that contacts the coupler 230. The contact face 251 is provided with a notch 253. The spacer 250 is removable from the coupler 230 through the notch 253. As the spacers 250 are removed, the pallet 110 separates from the sheet 210 without removing the couplers 230.

Accordingly, while the product 10 is transported with the securing device 200, the couplers 230 couple the sheet 210 to the pallet 110 precisely in a horizontal direction and a vertical direction, attaining safe transportation of the product 10 that is loaded. After the product 10 is unloaded, as the spacers 250 are removed, the sheet 210 separates from the pallet 110 readily, preventing increase in the number of work processes and facilitating separation and disposal per material during unpacking and disposing. Additionally, the securing device 200 has no extra sheet other than the pallet 110 and the sheet 210, preventing increase in wastes and costs compared to the securing device 200C as the second comparative example. Further, the couplers 230 do not contact the cargo handling device, preventing breakage of the couplers 230 during cargo handling. Since parts of the securing device 200 are manufactured without treating the pallet 110 with complex processing in advance, the pallet 110 is provided at reduced manufacturing costs.

The pallet 110 depicted in FIGS. 4A and 4B is made of plywood or wood and has the substantially rectangular contour when projected on the plane. The construction of the pallet 110 depicted in FIGS. 4A and 4B is equivalent to the construction of the pallet 110 that is described above with reference to FIGS. 1 and 2. The sheet 210 depicted in FIG. 4B is disposed on the pallet 110. The sheet 210 loads the product 10 and the cushioning materials 160 and is made of corrugated cardboard. The sheet 210 includes a plate 211 and flaps 212 and 214. The plate 211 is rectangular and is placed with the product 10. The flaps 212 are bent upward from two sides of four sides of the plate 211 as boundaries. The two sides of the plate 211 are at the fork insertion sides 180, respectively. The flaps 214 are bent upward from two sides of the plate 211 at the fork non-insertion sides 190 as boundaries, respectively. The flaps 212 and 214 are rectangular.

The product 10 loaded in the securing device 200 is an image forming apparatus as one example. The image forming apparatus includes a copier, a facsimile machine, a printer, and a multifunction peripheral (MFP) having two or more of copying, printing, scanning, facsimile, plotter, and other functions.

Alternatively, the securing device 200 according to the embodiments of the present disclosure is applicable to apparatuses and devices that transport electric appliances, other than the image forming apparatus, such as a large-sized television set, a refrigerator, and a washing machine.

The through holes 216 are aligned in two lines on the sheet 210 when seen from the fork insertion sides 180. Thus, the six through holes 216 are on the sheet 210 totally. The four through holes 216 of the six through holes 216 in total are disposed on four corners of the sheet 210, respectively.

Each of the other two through holes 216 is disposed on a center between the two corners. When the sheet 210 is placed on the pallet 110, those through holes 216 are on the deck boards 115.

A description is provided of processes for attaching the sheet 210.

The sheet 210 is placed on the pallet 110. Thereafter, the spacers 250 are placed on the sheet 210 such that the spacers 250 are disposed opposite the through holes 216, respectively. The couplers 230 are inserted from above into the through holes 216 through the spacers 250, respectively, securing the sheet 210 to the pallet 110. The spacer 250 is made of resin. As illustrated in FIG. 5, the coupler 230 includes a screw 230*a* made of metal and a washer 230*b*.

The screw 230*a* includes a wood screw or a pallet screw. As the screw 230*a* is fastened, the sheet 210 is coupled to the pallet 110 without treating the pallet 110 with processing in advance.

FIG. 5 is a schematic perspective view of the spacer 250 and the coupler 230.

As illustrated in FIG. 5, the spacer 250 is circular as a basic form. The spacer 250 includes an upper face 255, a side wall 257, the contact face 251, and the notch 253. The upper face 255 is planar and disposed along a circumference of the spacer 250. The side wall 257 abuts on the upper face 255. The contact face 251 is planar and disposed at substantially a center of the spacer 250 and below the upper face 255. The contact face 251 contacts the coupler 230. The contact face 251 is provided with the notch 253. The side wall 257 includes a first plane 257*a* and a second plane 257*b*. The first plane 257*a* is disposed opposite the notch 253. The second plane 257*b* is disposed opposite the notch 253 and abuts on the first plane 257*a*.

As described above, the spacer 250 includes the contact face 251 and the notch 253. While the spacer 250 is placed on the sheet 210, the coupler 230 constructed of the screw 230*a* and the washer 230*b* is attached to the sheet 210. Thus, the securing device 200 is assembled. Since the spacer 250 has the notch 253, as the spacer 250 is pulled out in a direction causing the coupler 230 to move through the notch 253, the spacer 250 is removed from between the sheet 210 and the coupler 230.

The coupler 230 includes the screw 230*a* made of metal and the washer 230*b*. The screw 230*a* serves as a protrusion inserted into the through hole 216 of the sheet 210 toward the pallet 110. The washer 230*b* is disposed on one end of the screw 230*a* and serves as an abutment that contacts the spacer 250. The coupler 230 combines the sheet 210 with the pallet 110 readily, facilitating assembly of the securing device 200. The screw 230*a* enters the sheet 210 through the notch 253 of the spacer 250. The sheet 210 disposed below the spacer 250 is provided with the through hole 216. The screw 230*a* is inserted into and penetrated through the through hole 216, thus being screwed into the pallet 110. When the washer 230*b* is disposed on the spacer 250, a lower face of the washer 230*b* comes into contact with the contact face 251 of the spacer 250. Since the contact face 251 is disposed below the upper face 255, the screw 230*a* does not protrude beyond the upper face 255 of the spacer 250.

Since the spacer 250 is made of resin, while the first plane 257*a* and the second plane 257*b* of the side wall 257 of the spacer 250 are disposed opposite a mouth of the notch 253, that is, disposed at a side of the spacer 250 that is opposite a side thereof where the mouth of the notch 253 is situated, the first plane 257*a* and the second plane 257*b* are molded and combined with the mouth of the notch 253. Since the first plane 257*a* and the second plane 257*b* are disposed at the side opposite the side of the mouth of the notch 253, the spacer 250 is separated from and drawn out of the securing device 200 readily when unpacking and disposing.

As described above, since the spacer 250 is made of resin, a plurality of walls of the spacer 250, that is, the first plane 257*a* and the second plane 257*b* of the side wall 257, is molded and combined into a unit. Additionally, as described below with reference to FIG. 8, in view of a distance between the spacer 250 on the pallet 110 and an exterior box (e.g., the box 120), the identical spacer 250 contacts a corner and a plane of the exterior box. Since the plurality of walls of the spacer 250 is molded and combined into the unit, a plurality of types of spacers is not employed, reducing manufacturing costs.

Figure 6A:
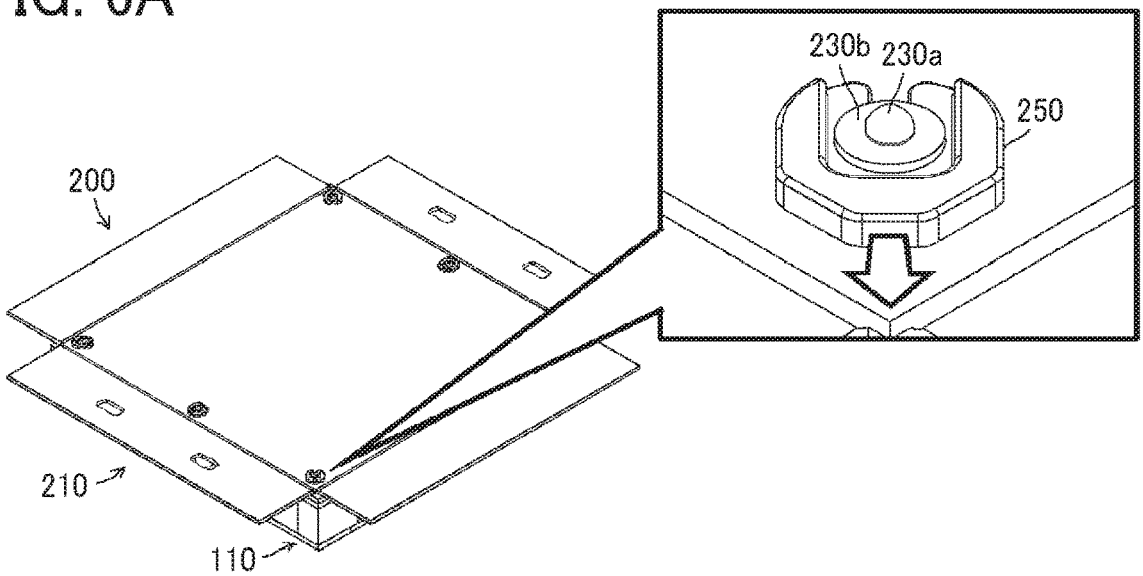
FIG. 6A is a schematic perspective view of the securing device depicted in FIG. 4A, illustrating a sheet secured to a pallet with the spacer and the coupler.
Figure 6B:
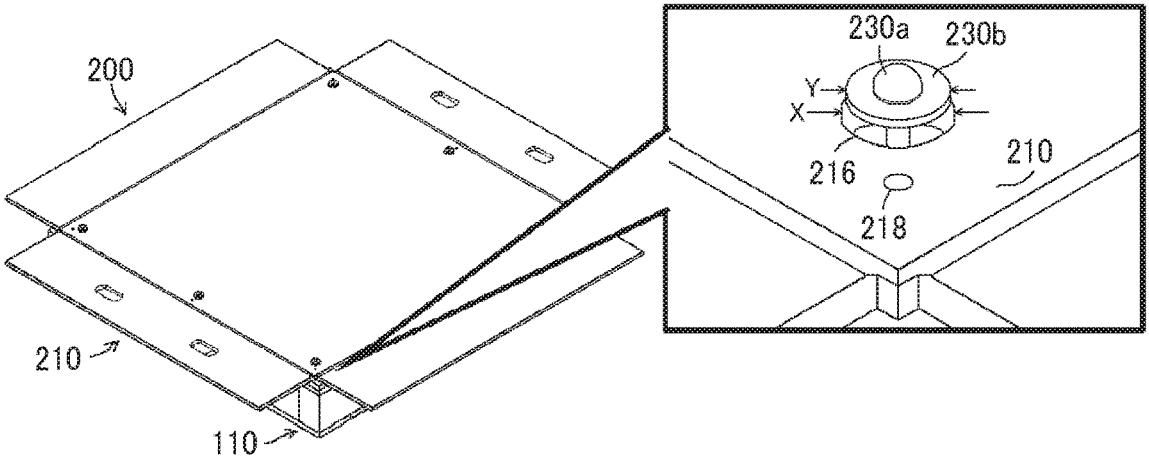
FIG. 6B is a schematic perspective view of the securing device depicted in FIG. 6A after the spacer is pulled out.
Figure 6C:
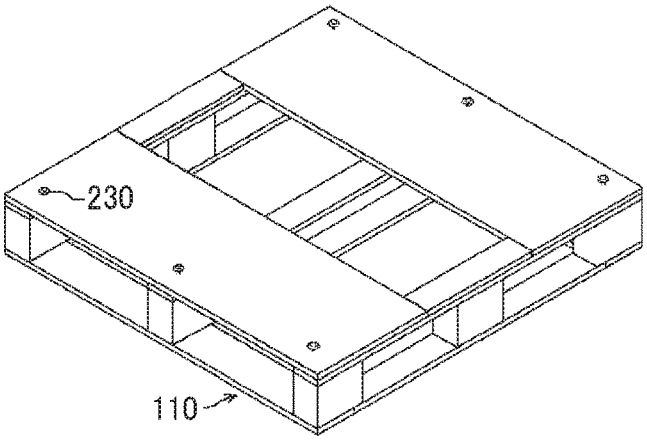
FIG. 6C is a schematic perspective view of the pallet depicted in FIG. 6A after the sheet is pulled out upward.

Referring to FIGS. 6A, 6B, and 6C, a description is provided of processes for removing the spacer 250 and the sheet 210.

Like FIG. 4A, FIG. 6A is a schematic perspective view of the sheet 210 secured to the pallet 110 with the coupler 230 and the spacer 250. FIG. 6A also illustrates an enlarged view of a corner of the sheet 210.

In order to remove the sheet 210, the spacer 250 is pulled outward, that is, in the direction causing the coupler 230 to move through the notch 253. Since the sheet 210 disposed below the spacer 250 is made of corrugated cardboard, the sheet 210 may be broken by pressure from above. Accordingly, friction between the spacer 250 and the sheet 210 decreases and the spacer 250 is pulled outward readily. The spacer 250 secures the sheet 210 to the pallet 110 precisely and is removed without a special tool.

As described below with reference to FIGS. 7A, 7B, and 7C, if the spacer 250 mounts a projection 259 on a back face of the spacer 250, as the first plane 257*a* of the spacer 250 and an abutment portion of the upper face 255, which abuts on the first plane 257*a*, are lifted, the spacer 250 made of resin is bent. Accordingly, the projection 259 surmounts a recess 218 of the sheet 210, allowing the spacer 250 to be pulled out.

FIG. 6B is a schematic perspective view of the securing device 200 after the spacer 250 is pulled out.

After the spacer 250 is pulled outward, as illustrated in an enlarged view in FIG. 6B, the coupler 230 and the sheet 210 that are secured to the pallet 110 remain. A diameter X of the through hole 216 produced in the sheet 210 in advance is greater than an outer diameter Y of the washer 230*b*. Accordingly, the sheet 210 is pulled out upward above the washer 230*b*.

For example, the washer 230*b* has a diameter of 25 mm and the through hole 216 of the sheet 210 has a diameter of 25 mm or greater. However, a maximum diameter of the through hole 216 is in a range that renders the through hole 216 to hide under the spacer 250, that is, a size smaller than the spacer 250.

FIG. 6C is a schematic perspective view of the pallet 110 after the sheet 210 is pulled out upward.

As illustrated in FIG. 6C, after the sheet 210 is pulled out, the pallet 110 and the coupler 230 secured to the pallet 110 remain.

Figure 7A:
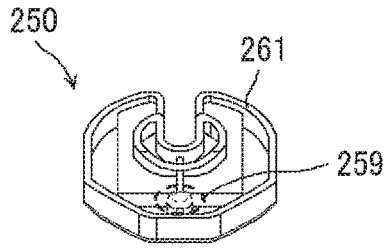
FIG. 7A is a schematic perspective view of a back face of the spacer depicted in FIG.
Figure 7B:
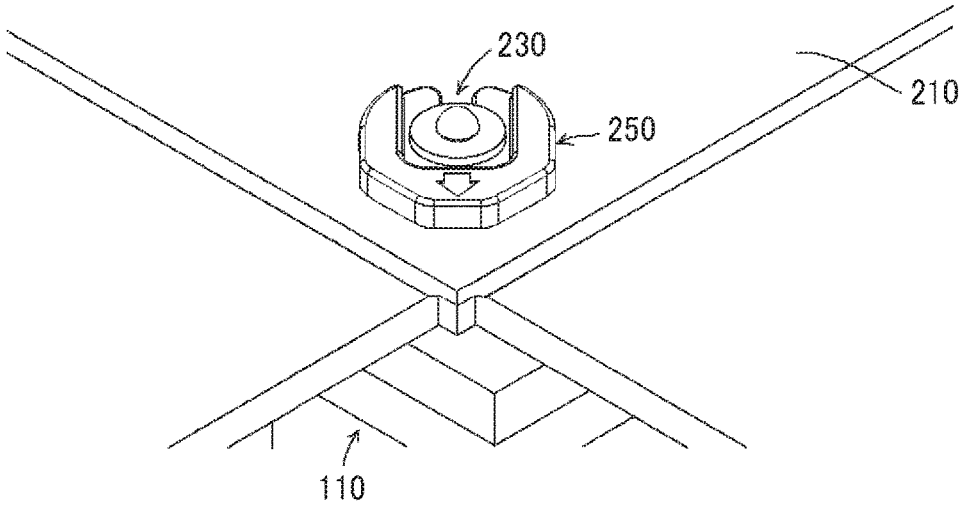
FIG. 7B is a schematic perspective view of the spacer depicted in FIG. 7A, which is attached to the sheet.
Figure 7C:
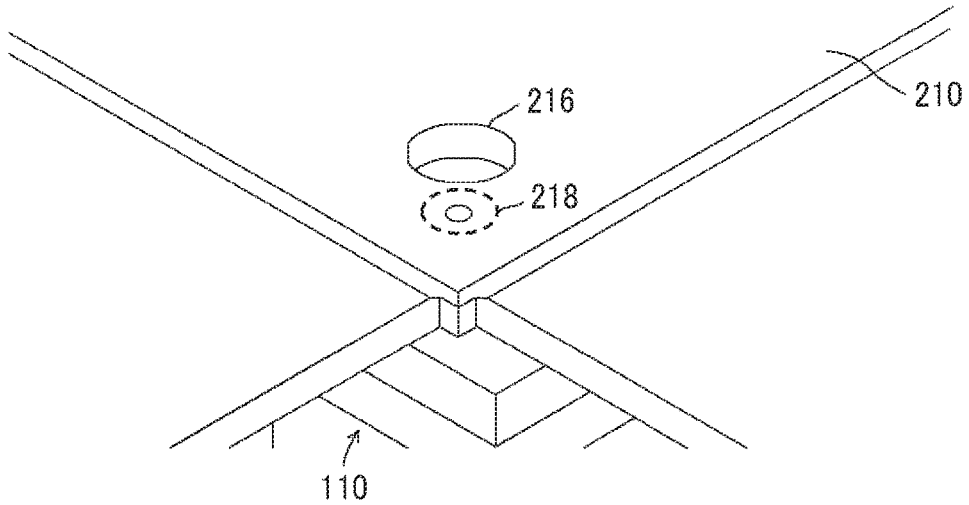
FIG. 7C is a schematic perspective view of a through hole disposed in the sheet depicted in FIG. 6A.

FIGS. 7A, 7B, and 7C are schematic views illustrating the back face of the spacer 250, the through hole 216, and other elements. FIG. 7A is a schematic perspective view of the back face of the spacer 250. FIG. 7B is a schematic perspective view of the spacer 250 attached to the sheet 210. FIG. 7C is a schematic perspective view of the through hole 216.

As illustrated in FIG. 7A, the projection 259 is mounted on the back face of the spacer 250. The projection 259 protrudes upward beyond one plane defined by a back face rim 261. As illustrated in FIG. 7C, the sheet 210 is provided with the recess 218 that engages the projection 259. As the projection 259 mounted on the back face of the spacer 250 engages the recess 218, the recess 218 positions the spacer 250 with respect to the sheet 210 as illustrated in FIG. 7B and suppresses rotation and movement of the spacer 250, preventing the spacer 250 from dropping off from the sheet 210. Accordingly, the securing device 200 prevents the product 10 from being damaged or broken while the product 10 is transported and the packing apparatus 100 is delivered. The recess 218 may be a through hole that penetrates through the sheet 210 or a depression that does not penetrate through the sheet 210.

Figure 8:
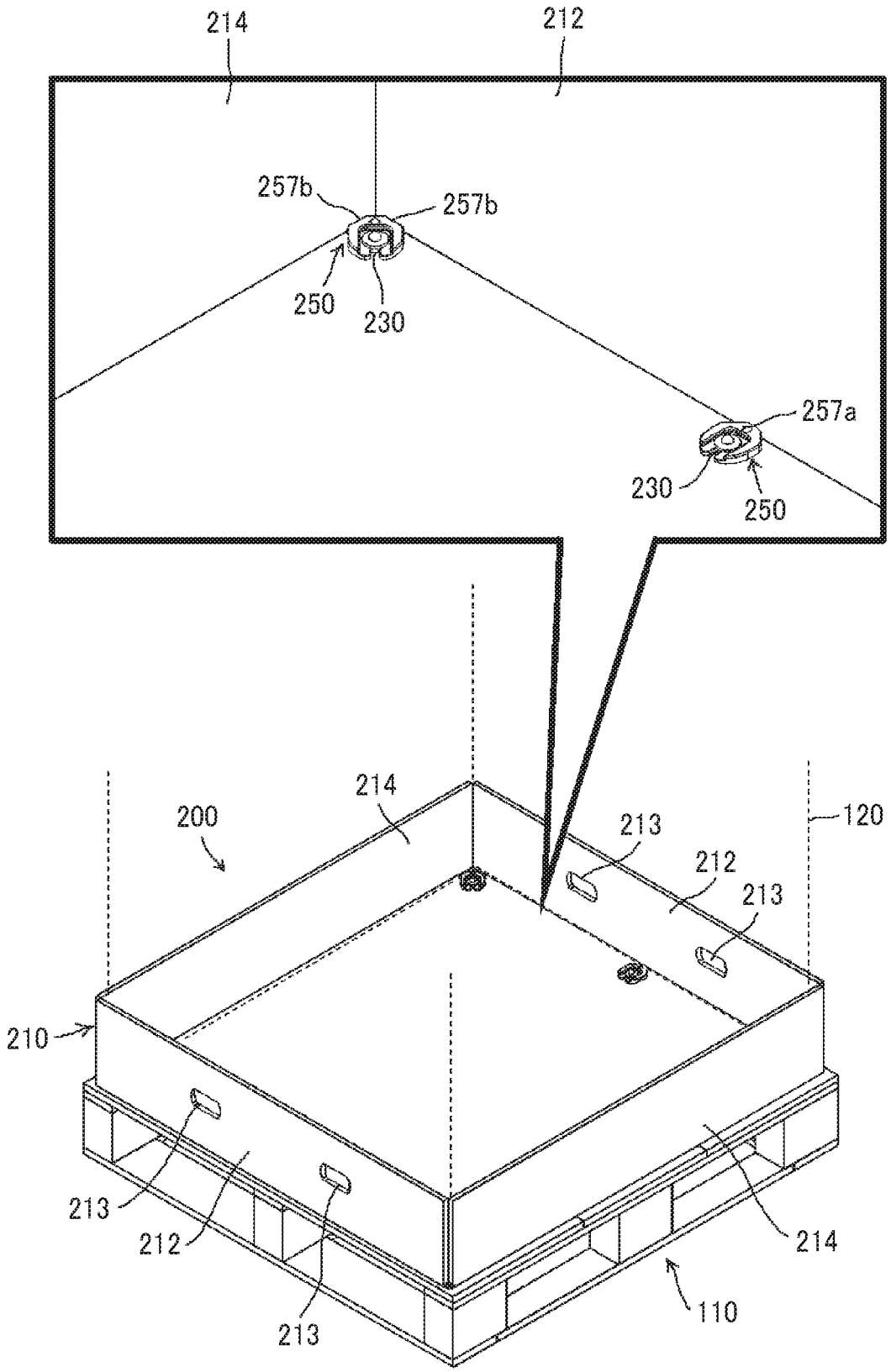
FIG. 8 is a schematic perspective view of the securing device depicted in FIG. 4B, illustrating flaps that stand up.

FIG. 8 is a schematic perspective view of the securing device 200 when the flaps 212 and 214 stand up.

As described above with reference to FIG. 5, the side wall 257 of the spacer 250 includes the first plane 257*a* disposed opposite the notch 253 and the second plane 257*b* abutting on the first plane 257*a*. As illustrated in FIG. 8, when the sheet 210 is used to load the product 10, the flaps 212 and 214 serving as a periphery of the sheet 210 are stood up and edges of the flaps 212 and 214 at four corners of the sheet 210 are secured with tape or the like. If the box 120 indicated in a dotted line in FIG. 8 and in a solid line in FIG. 2 is used, the box 120 is placed within a fence defined by the flaps 212 and 214 that stand up and covered by the flaps 212 and 214. As illustrated in an enlarged view in FIG. 8, the side wall 257 of the spacer 250 contacts interior faces of the flaps 212 and 214 that stand up or interior faces of the box 120, respectively. For example, the second planes 257*b* of the side wall 257 of the spacer 250 disposed at a corner contact the interior faces of the flaps 212 and 214 that stand up or the interior faces of the box 120 disposed within the fence defined by the flaps 212 and 214 that stand up and covered by the flaps 212 and 214, respectively. The first plane 257*a* of the side wall 257 of the spacer 250 disposed between two corners contacts the interior face of the flap 212 that stands up or the interior face of the box 120 disposed within the fence defined by the flap 212 that stands up and covered by the flap 212. Accordingly, the flaps 212 and 214 prevent the spacer 250 and the coupler 230 from moving and dropping off precisely.

A description is provided of unpacking with the packing apparatus 100 employing the securing device 200.

As illustrated in FIG. 8, in order to perform packing with the securing device 200, the securing device 200 is assembled. The product 10 illustrated in FIG. 2 is placed on the securing device 200. The box 120 lowers toward the product 10 and covers the product 10. Finally, the joints 150 made of resin are fastened to couple the box 120 to the sheet 210. Thus, the box 120 is coupled to the sheet 210 with the joints 150 made of resin illustrated in FIGS. 1 and 2.

As illustrated in FIG. 8, the flap 212 includes slots 213 that are disposed opposite the through holes 127 as the box 120 is placed on the sheet 210. The joints 150 couple the box 120 to the sheet 210 through the slots 213, respectively.

Accordingly, in order to perform unpacking, when the packing apparatus 100 accommodating the product 10 is delivered, the joints 150 are removed so that the joints 150 and the box 120 are removed earlier. After removal of the box 120, the securing device 200 remains as illustrated in FIG. 8, Thereafter, the spacers 250 are removed according to the processes described above with reference to FIGS. 6A, 6B, and 6C. As the spacers 250 are removed, the sheet 210 is moved upward and removed without removal of the couplers 230. Thus, the pallet 110 separates from the sheet 210, reducing wastes and costs and decreasing the number of processes for unpacking and disposing.

A description is provided of advantages of a securing device (e.g., the securing device 200).

As illustrated in 4A and 4B, the securing device includes a base (e.g., the pallet 110), a sheet (e.g., the sheet 210), a securing support (e.g., the spacer 250), and a coupler (e.g., the coupler 230). The sheet includes a hole (e.g., the through hole 216) and is placed on the base. The securing support is disposed opposite the hole of the sheet. The coupler secures the sheet to the base through the securing support. As illustrated in FIG. 5, the securing support includes a contact face (e.g., the contact face 251) that contacts the coupler. The contact face includes a notch (e.g., the notch 253), The securing support is removed from the coupler through the notch. As the securing support is removed from the coupler, the base separates from the sheet without removing the coupler.

Thus, the securing device reduces wastes and costs and decreases the number of processes for unpacking and disposing.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present disclosure.

Any one of the above-described operations may be performed in various other ways, for example, in an order different from the one described above.

What is claimed is:

1. A securing device comprising:

a base;

a sheet placed on the base, the sheet including a hole;

a securing support disposed opposite the hole of the sheet; and a coupler to secure the sheet to the base through the securing support, the securing support including a contact face to contact the coupler; the contact face including a notch through which the securing support is removed from the coupler to separate the base from the sheet without removing the coupler.

2. The securing device according to claim 1, wherein a diameter of the hole is greater than an outer diameter of the coupler.

3. The securing device according to claim 1, wherein the securing support further includes a projection on a back face of the securing support, and wherein the sheet further includes a recess to engage the projection.

4. The securing device according to claim 1, further comprising a box, wherein the sheet further includes a flap that stands up, the flap to cover the box disposed within the flap, and wherein the securing support further includes a side wall including:

a first plane; and a second plane abutting on the first plane, the second plane, together with the first plane; to contact one of the flap and the box.

5. The securing device according to claim 4, wherein the first plane and the second plane of the side wall are disposed opposite the notch.

6. The securing device according to claim 1,
wherein the coupler includes:
a protrusion to penetrate through the hole of the sheet toward the base; and
an abutment, disposed at one end of the protrusion, to contact the securing support.

7. The securing device according to claim 6,
wherein the protrusion enters the sheet through the notch of the securing support.

8. The securing device according to claim 6,
wherein the protrusion includes a screw and the abutment includes a washer.

9. The securing device according to claim 1,
wherein the securing support further includes a spacer.

10. The securing device according to claim 1,
wherein the base includes a pallet.

* * * * *